US005751102A

United States Patent [19]

Tanaka et al.

[11] Patent Number: 5,751,102

[45] Date of Patent: May 12, 1998

[54] MONOCHROMATIC CATHODE RAY TUBE HAVING SCATTERED ELECTRON SUPPRESSING LAYER

[75] Inventors: Takaaki Tanaka, Katano; Masahide Yamauchi, Suita; Yasuhisa Ishikura, Katano; Masaki Aoki, Mino, all of Japan

[73] Assignee: Matsushita Electric Industrial Co., Ltd., Japan

[21] Appl. No.: 885,838

[22] Filed: Jun. 30, 1997

Related U.S. Application Data

[63] Continuation of Ser. No. 429,872, Apr. 27, 1995, abandoned.

[30] Foreign Application Priority Data

May 2, 1994 [JP] Japan ..... 6-093169
Feb. 23, 1995 [JP] Japan ..... 7-034882

[51] Int. Cl.[6] ..... H01J 29/18

[52] U.S. Cl. ..... 313/466; 313/479; 313/473; 313/461

[58] Field of Search ..... 313/461, 466, 313/473, 479; 427/64, 68; 428/690

[56] References Cited

U.S. PATENT DOCUMENTS

| | | | |
|---|---|---|---|
| 2,438,668 | 3/1948 | Koch et al. | 313/466 |
| 2,878,411 | 3/1959 | Alvarez . | |
| 3,911,165 | 10/1975 | Kanai et al. | 313/466 |
| 4,221,990 | 9/1980 | Yamazaki et al. | 313/466 |
| 4,612,483 | 9/1986 | Washington . | |
| 4,623,820 | 11/1986 | Deal et al. | 313/466 |
| 4,723,090 | 2/1988 | Maeda et al. | 313/479 |
| 5,451,835 | 9/1995 | Yamazaki et al. | 313/466 |

FOREIGN PATENT DOCUMENTS

| | | | |
|---|---|---|---|
| 54-5375 | 1/1979 | Japan | 313/466 |
| 58-82449 | 5/1983 | Japan | 313/466 |
| 61-48753 | 7/1986 | Japan . | |

*Primary Examiner*—Nimeshkumar Patel
*Attorney, Agent, or Firm*—Beveridge, DeGrandi, Weilacher & Young, LLP

[57] ABSTRACT

The present invention concerns a cathode ray display tube in which the layers of a scattered electrons suppressing material are formed on the surface of a metal back layer on a phosphor layer and the inner surface of a funnel part. Each of the scattered electrons suppressing material layers on the surface of the metal back layer and on the inner surface of the funnel part is formed with an amount per unit area within specific ranges. The scattered electrons suppressing material layer is provided to form a laminated layer which is composed of lamina shaped graphite particles with a diameter which is ten times or more as large as a thickness and an average particle size in terms of spherical volume not more than 2 μm. The scattered electrons suppressing material layers reduce unnecessary light emission due to scattered electrons and improve the contrast of a display image. A projection display system providing a display image with high contrast can be constituted by using the cathode display tubes.

6 Claims, 4 Drawing Sheets

MONOCHROMATIC CATHODE RAY TUBE HAVING SCATTERED ELECTRON SUPPRESSING LAYER

This application is a continuation of application Ser. No. 08/429,872, filed Apr. 27, 1995, now abandoned.

BACKGROUND OF THE INVENTION

1. Field of the Invention

The present invention relates to a cathode ray display tube and a projection display system using the cathode ray display tube, and more particularly to a monochrome cathode ray display tube using high accelerating voltage which can realize a display image of high contrast.

2. Description of the Prior Art

A cathode ray display tube has been widely employed as a display device in image information equipment and occupied a significantly important place. There have been attempts to improve the quality of an image of the cathode ray display tube, specifically, contrast.

One of these measures is to form a layer composed of low atomic number constituents such as carbon atoms or boron atoms on the surface of a face panel for forming a phosphor layer of a post-deflection acceleration cathode ray display tube so that the layer suppresses electrons scattering. This has been attempted at one time in the course of development of the cathode ray display tube for solving the problem of deterioration of image quality. (disclosed in U.S. Pat. No. 2,878,411).

Further, a technique to improve the contrast with a structure of the tube has been devised, in which the side wall surface of the cathode ray tube is applied with a voltage as high as that of an anode electrode, or a shadow mask or the like is provided immediately before an anode electrode, so that electrons scattered from the surface of the anode electrode are trapped, thereby preventing the scattered electrons from reentering the anode electrode to suppress the halation. Nowadays, this structure is adopted in most of the present color cathode ray display tubes with high image quality.

On the other hand, in the monochrome cathode ray display tube the shadow mask, in general, is not employed because of its shortcomings of increasing cost or deteriorating brightness.

FIG. 4 illustrates the construction of a conventional monochrome cathode ray display tube. Referring to FIG. 4, the conventional monochrome cathode ray display tube comprises a display tube envelope 1 connecting a neck part and a funnel part together with a face panel part, an electron gun 2 accommodated in the neck part, a phosphor layer 3 formed on the inner surface of the face panel and a metal back 4 which is a metal film formed on the phosphor layer 3. In this conventional monochrome cathode ray display tube, an electron beam 5 accelerated by the electron gun 2 is incident upon the phosphor layer 3, so that phosphorous materials are excited thereby emitting light and forming a picture image. In the above described monochrome cathode ray display tube, as shown in FIG. 4, the electron beam 5 is accelerated by the electron gun 2 and incident upon the phosphor layer 3, a part of which beam is scattered as scattered electrons 6 on the metal back 4 or the phosphor layer 3. The scattered electrons 6 are further scattered on the inner surface of the funnel part accompanied with the generation of secondary scattered electrons 7 which are also incident upon the phosphorous layer, thereby producing an unnecessary light emission which lowers the contrast of a displayed image. Since the monochrome cathode ray display tube is not provided with the shadow mask as in the case of a color cathode ray display tube, the electrons which incident upon the phosphor layer again are not conveniently trapped which causes difficulty in improving the contrast of the displayed image.

In recent years, a projection display system has been developed and popularized as a large screen display device. The projection tube utilized in the projection display system is the monochrome cathode ray display tube in question.

In this projection display system, the improvement of the contrast of the display image, which is formed on the projection tube and projected on a screen by means of a projection lens, has been generally performed by utilizing an optical coupling technique, in which the face panel part of the projection tube and the projection lens are optically coupled. With this technique, unnecessary light incident upon the phosphor layer of the projection tube has been reduced and the contrast of the display image has been enhanced. However, this does not provide the image with enough contrast to make the image appreciative. The lowered contrast of the display image of the projection display system is not always caused by the unnecessary light from the projection display system. In addition to the lack of the shadow mask in the projection tube, its high electron acceleration voltage is also one of the other major causes for lowering the contrast, which voltage is equal to or greater than 25 kV in order to realize a bright image and a small electron beam spot. Thus, the electron beam accelerated with such a high voltage produces scattered electrons. Also, the electron beam is provided with extremely high energy enough to deteriorate the contrast of the display image.

An example of the method for improving the contrast of the display image is disclosed in Japanese Unexamined Patent Publication No. sho. 61-148753 in which the inner surface of a display tube except a face panel for forming a phosphor layer is coated with a low electron scattering material. In accordance with this method, however, while low energy scattered electrons caused by an electron beam accelerated by a low voltage can be completely suppressed, high energy scattered electrons, which are caused by an electron beam accelerated by a voltage equal to or greater than 25 kV as in the case of a projection tube used for a CRT type projection display or the like, are difficult to satisfactorily suppress.

Further, in the method such as disclosed in U.S. Pat. No. 2,878,411, which suppresses scattered electrons by providing a layer composed of low atomic number constituents such as carbon atoms or boron atoms on a phosphor layer on the inner surface of a face panel, the amount per unit area m ($\mu g/cm^2$) of a scattered electrons suppressing layer is increased relative to the acceleration voltage $V_a$ (kV) to be as high as 0.35 to 0.7 $V_a^2$ in order to obtain a sufficient contrast improving effect, thereby bringing about a disadvantage that the energy of a transmitted electron beam is seriously attenuated to significantly lower brightness.

A practical technique for forming the scattered electrons suppressing layer is to use particles of material composed of a low atomic number such as carbon. In this case, however, carbon particles may be scattered and dissipated to lower reliability.

As mentioned, the technique of providing a shadow mask immediately before the surface of a phosphor layer of the face panel for trapping scattered electrons is significantly effective in improving the contrast of a displayed image. The shadow mask, however, undesirably results in an increase in cost or the deterioration of brightness when used.

SUMMARY OF THE INVENTION

An object of the present invention is to suitably overcome these problems and to provide a display image with high contrast and a high reliability in a monochrome cathode ray display tube employing a high electron acceleration voltage.

In accordance with the present invention, this object can be attained by the following improvements applied to the cathode ray display tube.

A first feature of the present invention resides in a cathode ray display tube comprising: a neck part accommodating a electron gun; a funnel part connected to this neck part; a face panel part connected to this funnel part; a phosphor layer formed on the inner surface side of this face panel part; a metal back layer formed with a metal thin film which is provided over the surface of the phosphor layer opposed to the electron gun; and a scattered electrons suppressing material layer provided on at least each of the surface of the metal back layer over the phosphor layer and the inner surface of the funnel part formed on the inner surface of a display tube case. The low electron scattering material. layer being formed with an element or a compound composed of atoms with a smaller atomic number than that of atoms forming the metal thin film.

A second feature of the present invention is directed to a cathode ray display tube in which the amount per unit area m ($\mu g/cm^2$) of the scattered electrons suppressing material layers, which are provided on at least both of the surface of the metal back layer over the phosphor layer and the inner surface of the funnel part formed on the inner surface of a display tube case with an element or a compound composed of atoms with an atomic number not less than 3 and not more than 10, are determined in accordance with the electron acceleration voltage $V_a$ of at least 25 kV as being within a range expressed by a Mathematical Formula 1 described below for the layer on the metal back surface of the phosphor layer, and/or within a range expressed by a Mathematical Formula 2 for the layer on the inner surface of the funnel part.

[Mathematical Formula 1]

$$0.05\times V_a^2 \leqq m \leqq 0.35\times V_a^2$$

[Mathematical Formula 2]

$$m \geqq 0.1\times V_a^2$$

In accordance with the construction of the cathode ray display tube of the present invention, the layers of a scattered electrons suppressing material are provided on at least each of the surface of the metal back layer over the phosphor layer and the inner surface of the funnel part formed on the inner surface of the display tube case, so that electrons scattered on the metal back layer and the phosphor layer can be reduced and, in addition, secondary scattered electrons generated on the inner surface of the funnel part are reduced. Therefore, a cathode ray display tube can be achieved which is capable of displaying an image with high contrast.

Moreover, by providing the layers of a low electron scattering material, which are formed with an element or a compound composed of atoms with an atomic number not less than 3 and not more than 10, respectively on the surface of the metal back layer and the inner surface of the funnel part with appropriate range of thickness in accordance with an electron acceleration voltage, the energy reduction of a transmitted electron beam can be prevented under a predetermined value to provide an effect for electron scattering suppression below a predetermined level. Accordingly, there can be realized a cathode ray display tube for displaying an image with little brightness reduction and high contrast.

In addition, the scattered electrons suppressing material layer is formed by laminating lamina shaped fine graphite particles each of which has a diameter which is ten times as large as a thickness or more and an average particle size in terms of spherical volume of not more than 2 μm, so that the fine graphite particles are uniformly dispersed and laminated to minimize unevenness in the thickness of a carbon layer after baking an anode at a high temperature, thereby providing an uniform and more reliable electrons scattering suppressing effect of the carbon layer. Furthermore, with the above mentioned thickness to diameter ratio, the graphite particles are oriented in line on the surface of the metal layer so that the contact areas between the particles and the metal layer are increased to remarkably strengthen the adhesion of the particles, which contributes to the enhancement of reliability of the present cathode ray display tube.

BRIEF DESCRIPTION OF THE DRAWINGS

The invention will now be described by way of examples, with reference to the accompanying drawings, in which.

DETAILED DESCRIPTION OF THE PREFERRED EMBODIMENT

The structure and functional effect of a cathode ray display tube and a projection display system using the cathode ray display tube of the present invention will now be described by referring to the accompanying drawings and Tables.

Figure 1:
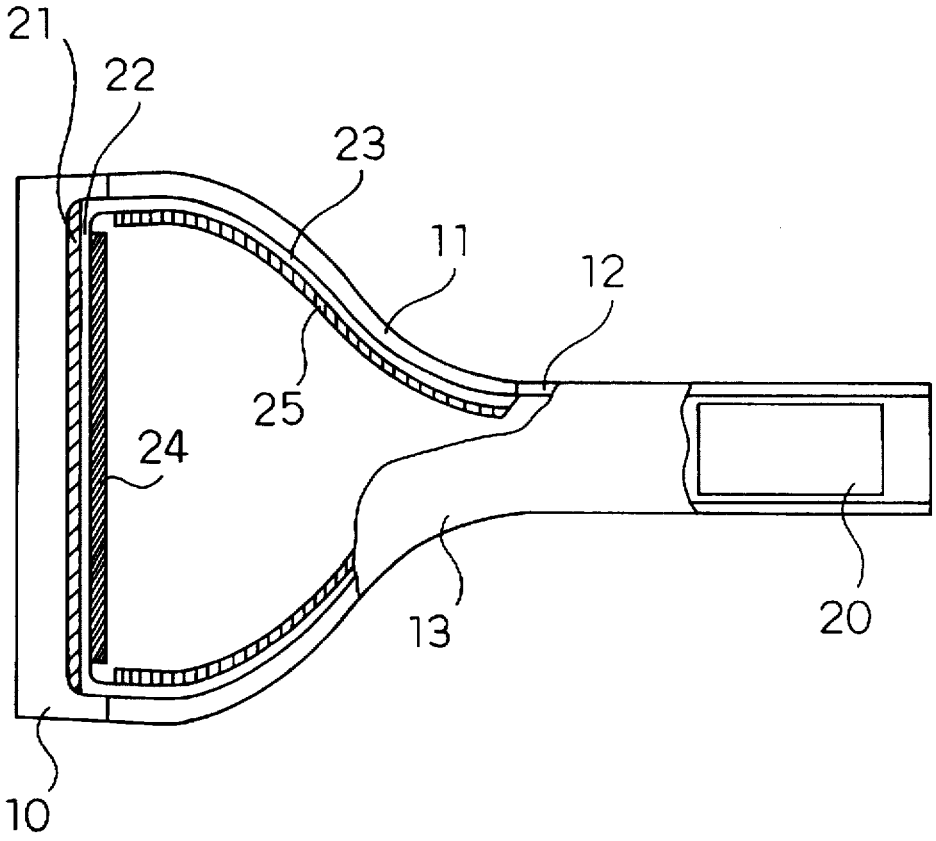
FIG. 1 is a diagrammatic view of a cathode ray display tube showing an embodiment of the present invention.

Referring to FIG. 1 illustrating the construction of a cathode ray display tube according to a first embodiment of the present invention, a face panel 10, a funnel part 11, and a neck part 12 are connected together as a unitary member in a display tube envelope 13. An electron gun 20 is housed in the neck part 12. A phosphor layer 21 is formed in the inner surface side of the face panel part 10. A metal back layer 22 which is an aluminum thin film layer is formed on the surface of the phosphor layer opposed to the electron gun 20. An aluminum film 23 is formed on the inner surface of the funnel part. A carbon layer 24 is formed on the metal back surface of the phosphor layer and a carbon layer 25 is formed on the inner surface of the funnel part.

The phosphor layer 21 is formed on the inner surface of the face panel 10 by a sedimentation coating method. The metal back layer 22 is formed in such a way that deposits aluminum on the phosphor layer 21 by a vacuum deposition method. When this metal back layer 22 is formed, an aluminum thin film is deposited not only on the phosphor layer 21, but also on the inner surface of the funnel part 11 continuous thereto. The metal back layer 22 has a function for reflecting light emitted from the phosphor layer 21 toward the side of the face panel 10 and enhancing the brightness of light emission from the phosphor layer 21. The aluminum thin film 23 formed on the inner surface of the funnel part 11 is not provided with such a function as that of the metal back layer 22. This aluminum film instead has a function for transferring a plate voltage supplied from the anode button of the funnel part (not illustrated) to the phosphor layer 21 as well as a function for maintaining the inner surface of the funnel part in a state of equipotential. The carbon layer as a low electron scattering material layer, which has atoms with a lower atomic number than that of an aluminum material film forming the metal back layer, is formed on the metal back layer 22 and on the aluminum thin film 23 on the inner surface of the funnel part 11.

Figure 4:
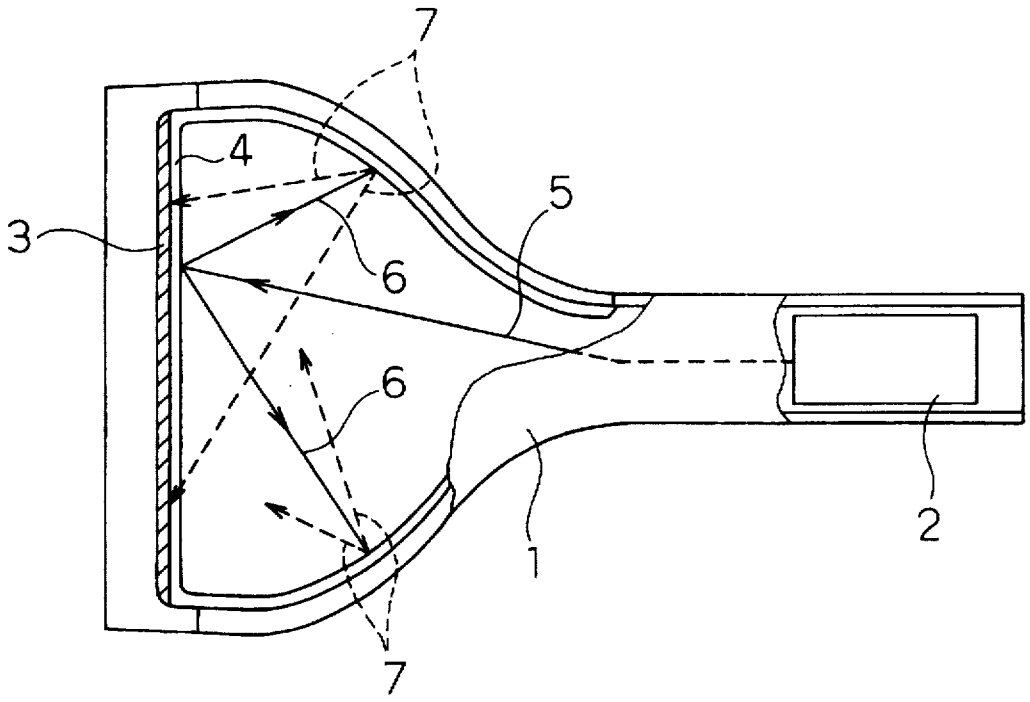
Fig. 4 (PRIOR ART)
FIG. 4 is a diagrammatic view of a conventional monochrome cathode ray display tube.

A part of an electron beam emitted from the electron gun 20 produces scattered electrons upon entering the carbon layer 24. The scattered electrons thus produced are incident upon the carbon layer 25, and then, the secondary scattered electrons are produced which are incident upon the phosphor layer. In general, the generated amount of scattered electrons is determined by the atomic number of the atoms of materials on which the electron beam is incident and the energy of the incident electrons. Usually, the generated amount of the scattered electrons is increased substantially in proportion to the increase in the atomic number. The atomic number is 6 for carbon, and 13 for aluminum. Accordingly, the electrons with less quantity and energy are scattered from the carbon layer 24 than a conventional cathode ray display tube shown in FIG. 4 that is without the carbon layers 24 and 25. The scattered electrons are further decreased on being scattered on the carbon layer 25 provided on the inner surface of the funnel part so that the energy of the scattered electrons for causing halation is suppressed to such an extremely low level that the contrast of a display image can be greatly improved.

Figure 2:
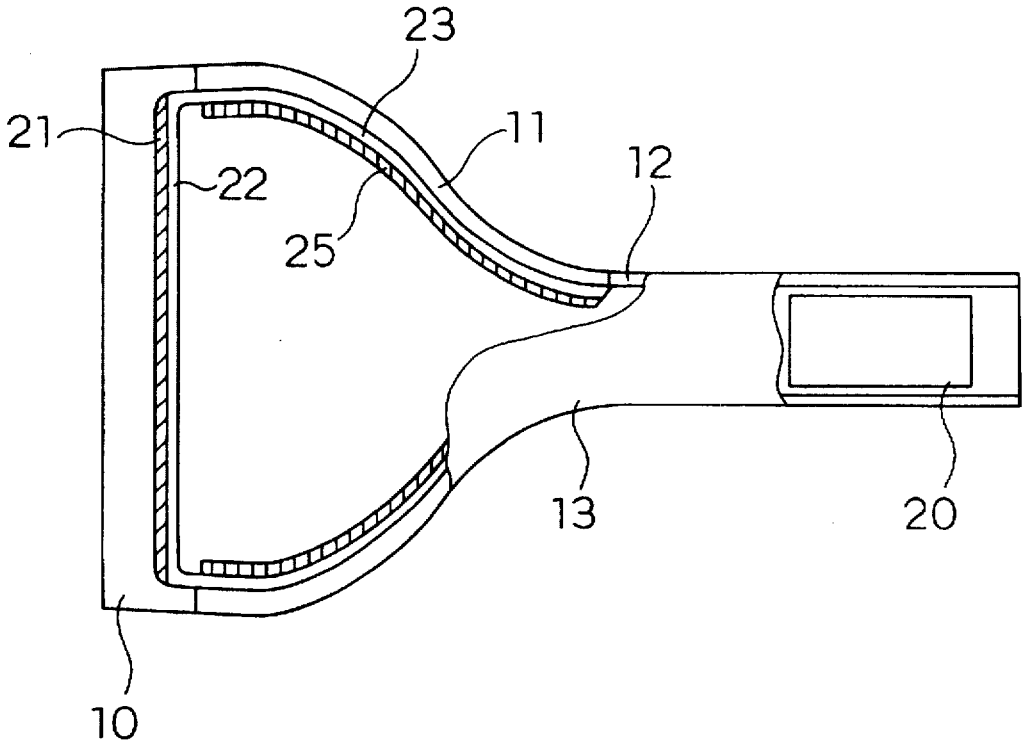
FIG. 2 is a diagrammatic view of a cathode ray display tube according to comparative examples relative to the present invention.

FIG. 2 illustrates the construction of a cathode ray display tube as an example for comparison with the present invention. A face panel 10 is connected to a funnel part 11. The funnel part 11 is connected to a neck part 12. A display tube envelope 13 connects the face panel 10, the funnel part 11 and the neck part 12 to form a unitary member. An electron gun 20 is accommodated in the neck part. A phosphor layer 21 is formed in the inner surface side of the face panel part. A metal back layer 22 of an aluminum thin film layer is formed on the surface of the phosphor layer opposed to the electron gun. An aluminum thin film 23 is formed on the inner surface of the funnel part. A carbon layer 25 is formed on the inner surface of the funnel part. As is apparent from FIG. 2, in accordance with this comparative example, a carbon layer is not formed on the metal back layer 22. The construction of the cathode ray display tube shown in FIG. 1 reduces the quantity and the energy of the electrons scattered on the carbon layer 24 formed on the metal back layer more than the construction shown in FIG. 2. The scattered electrons are further scattered on the carbon layer 25 formed on the inner surface of the funnel part, so that the energy of the scattered electrons for causing halation is suppressed to a significantly low level that the contrast of a display image can be remarkably improved.

Table 1 shows brightness and the halation to brightness ratio of the cathode ray display tube in the embodiments of the present invention compared with those in examples for comparison. They were obtained under an electron acceleration voltage of 32 kV. Each of the carbon layer 24 on the metal back layer and the carbon layer 25 on the inner surface of the funnel part in the embodiments and the examples for comparison is composed of graphite particles of an amount described in the Table 1. Both brightness and the halation to brightness ratio are expressed in relative values based on 100% when obtained for the case with zero amounts of the carbon layer 24 on the metal back layer and the carbon layer 25 on the inner surface of the funnel part.

The comparative examples 1 to 6 have the layers of graphite particles formed only on the metal back layer. With the amount of the graphite layer not less than 440 μg/cm$^2$, the halation to brightness ratio can be lowered. This, however, will also undesirably lower the brightness to not more than 80%.

TABLE 1

| Electron acceleration voltage of 32 kV | The amount of graphite on the metal back layer (μg/cm$^2$) | The amount of graphite on the inner surface of the funnel part (μg/cm$^2$) | Characteristics of display tube: Relative brightness % | Characteristics of display tube: Relative halation to brightness ratio % |
|---|---|---|---|---|
| Embodiment 1 | 60 | 100 | 98 | 70 |
| Embodiment 2 | 100 | 220 | 96 | 27 |
| Embodiment 3 | 100 | 440 | 96 | 16 |
| Embodiment 4 | 200 | 220 | 93 | 12 |
| Embodiment 5 | 200 | 440 | 93 | 7 |
| Embodiment 6 | 300 | 220 | 89 | 5 |
| Embodiment 7 | 300 | 440 | 89 | 4 |
| Embodiment 8 | 350 | 440 | 87 | 3 |
| Comparative Example 1 | 0 | 0 | 100 | 100 |
| Comparative Example 2 | 100 | 0 | 96 | 70 |
| Comparative Example 3 | 200 | 0 | 93 | 43 |
| Comparative Example 4 | 300 | 0 | 89 | 20 |
| Comparative Example 5 | 440 | 0 | 81 | 8 |
| Comparative Example 6 | 600 | 0 | 72 | 5 |
| Comparative Example 7 | 0 | 100 | 100 | 70 |
| Comparative Example 8 | 0 | 200 | 100 | 45 |
| Comparative Example 9 | 0 | 300 | 100 | 34 |
| Comparative Example 10 | 0 | 400 | 100 | 29 |
| Comparative Example 11 | 0 | 500 | 100 | 25 |
| Comparative Example 12 | 0 | 600 | 100 | 24 |

On the other hand, the comparative examples 7 to 12 are provided with the layers made of graphite particles only on the inner surface of the funnel part. Although the increased thickness of the graphite layer will lower the halation to brightness ratio, this decrease saturates at some thickness above which further decrease will be impossible.

In the embodiments 1 to 8 of the present invention, the layers of graphite particles are formed both on the metal back layer and on the inner surface of the funnel part. In this case, even if the amount of the graphite layer on the metal back layer is decreased as low as 200 μg/cm$^2$, a sufficiently low halation to brightness ratio can be obtained with a brightness of 90% or more that shows advantageously little reduction.

As stated above, in accordance with the construction of the embodiments of the present invention, even in a cathode ray display tube with an acceleration voltage as high as 32 kV, the completely decreased halation to brightness ratio (the increased contrast of a display image) can be obtained while maintaining a high brightness.

The results of the actual measurement show that for the electron acceleration voltage $V_a$ (kV), the amount of the graphite layer on the inner surface of the funnel part being not more than 0.1 $V_a^2$ μg/cm$^2$ provides an insufficient effect of suppressing scattered electrons. Hence, the amount of the graphite layer on the metal back layer has to be increased to cause the decrease in brightness. On the other hand, an increase in the amount of the graphite layer on the inner surface of the funnel part up to not less than 0.4 $V_a^2$ μg/cm$^2$ will result in undesirable saturation of the contrast improving effect. However, if there is no problem in adhesion strength of graphite particles, no other problems except for the saturation will be presented in increasing the amount of the graphite layer to not less than 0.4 $V_a^2$ μg/cm$^2$. Accordingly, forming the graphite layer on the inner surface of the funnel part with an amount not less than 0.1 $V_a^2$ μg/cm$^2$ will provide a high contrast improving effect.

With respect to the graphite layer on the metal back layer, an amount more than 0.05 $V_a^2$ μg/cm$^2$ does provide a desirable contrast improving effect, while an amount more than 0.35 $V_a^2$ μg/cm$^2$ results in the saturation of the contrast value which prevents the contrast from being improved, and serious reduction of the brightness, with which satisfactory characteristics cannot be obtained. Consequently, the amount of the graphite layer on the metal back layer ranging from 0.05 $V_a^2$ μg/cm$^2$ to 0.35 $V_a^2$ μg/cm$^2$ provides the display tube with a characteristics of a high brightness compatible with a high contrast.

Table 2 shows the degree of unevenness in the thickness of the carbon layer and the level of halation for the thickness to diameter ratio and the size of the graphite particles used in the carbon layers 24 and 25 in the embodiments of the present invention. The adhesion strength of the graphite particle layer will be also shown in this Table.

As can be understood from Table 2, the graphite particles having smaller thickness to diameter ratio is generally liable to have larger average particle size and to form the carbon layer with larger unevenness in the thickness. Further, as apparent from Table 2, the particles having the smaller thickness to diameter ratio and the smaller particle size exhibit relatively desirable characteristics as a display tube. However, with such graphite particle layers might have low reliability due to the weak adhesion strength of the graphite particles. A desirable compromise for the carbon layer is to use the graphite fine particles having the thickness to diameter ratio not less than 1:10 and the average particle size in terms of spherical volume not more than 2.0 μm. Further higher adhesion strength and reliability are obtained with the preferably determined thickness to diameter ratio not less than 1:15 and average particle size in terms of spherical volume not more than 1.5 μm.

In the present invention, it will be noted that the inner surface of the funnel part 11 may be provided with only the carbon layer 25, which is required only to be conductive enough to have a function for transferring and supplying the anode voltage to the phosphor layer 21.

TABLE 2

| | Thickness to diameter ratio of graphite particle | Average particle size (μm) | Degree of unevenness in thickness | Level of halation | Adhesion strength of graphite particles |
|---|---|---|---|---|---|
| Embodiment 9 | 1:15 | 1.5 | small | low | strong |
| Embodiment 10 | 1:20 | 1.2 | small | low | strong |
| Embodiment 11 | 1:30 | 1.0 | small | low | considerably strong |
| Embodiment 12 | 1:35 | 0.5 | small | low | very strong |
| Comparative Example 13 | 1:5 | 3.0 | large | high | weak |
| Comparative Example 14 | 1:8 | 2.5 | large | high | weak |
| Comparative Example 15 | 1:15 | 2.5 | medium | intermediate | intermediate |
| Comparative Example 16 | 1:8 | 1.5 | small | low | weak |

Figure 3:
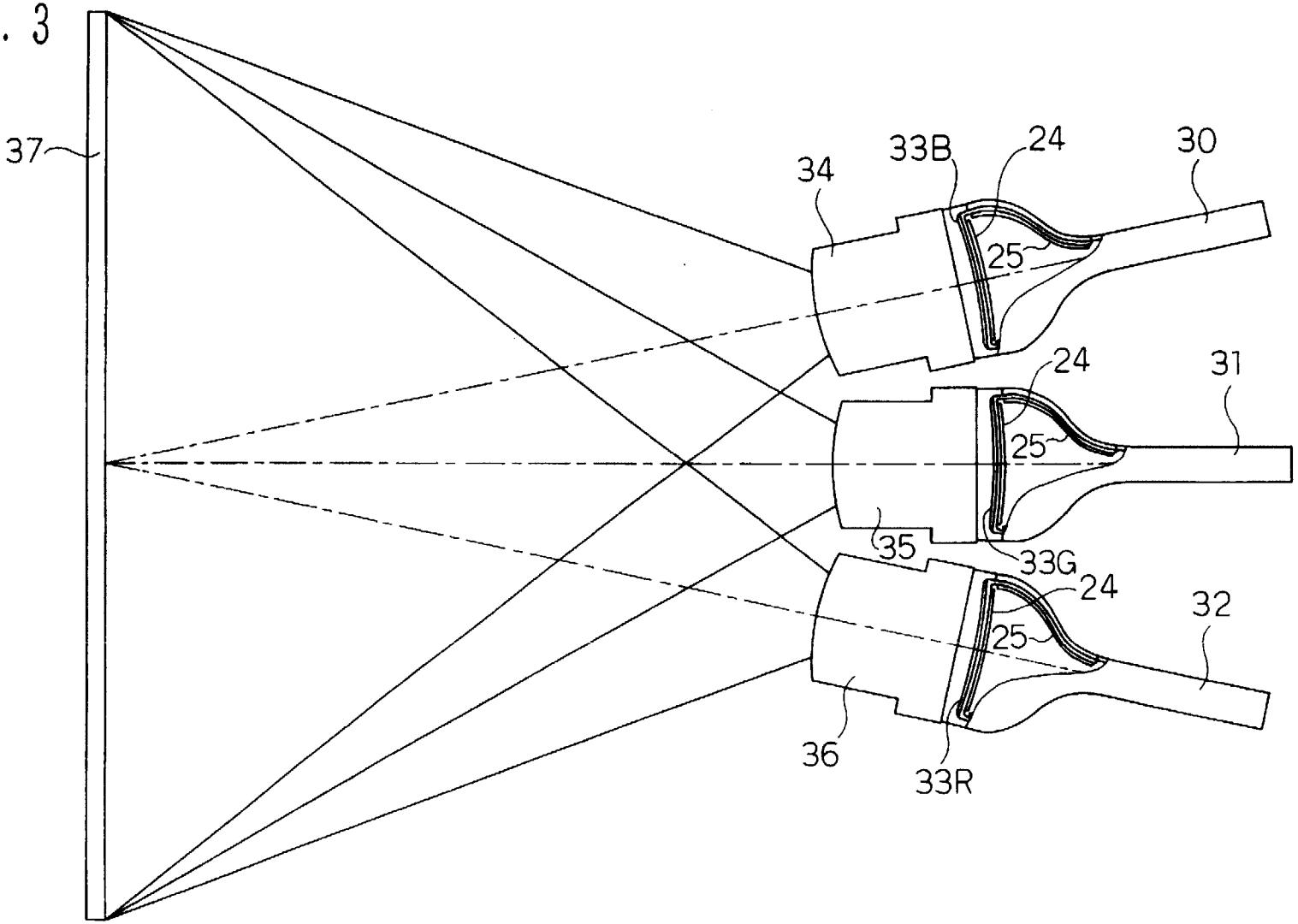
FIG. 3 is a diagrammatic view of a projection display system according to the present invention.

FIG. 3 illustrates the construction of a projection display system according to an embodiment of the present invention in which the cathode ray display tubes with the construction illustrated in FIG. 1 are adopted as projection tubes. Reference numerals 30, 31 and 32 respectively designate projection tubes of blue, green and red colors. Projection lenses 34, 35 and 36 respectively mounted on the blue, green and red colors projection tubes 30, 31 and 32. Reference numeral 37 shows a screen. Carbon layers 24 and 25 are respectively formed on the metal back layer and the inner surface of funnel part in each of the projection tubes 30, 31 and 32. Images, formed on the phosphor layers 33B, 33G and 33R of the projection tubes 30, 31, and 32 of blue, green and red colors in accordance with video signals, are enlarged and projected on the screen 37 by means of the three projection lenses 34, 35 and 36 corresponding to each image. The projected images in blue, green and red colors are combined on the screen 37 to reproduce a projected picture image in natural color.

The carbon layers 24 and 25 respectively formed on the metal back layer and the inner surface of the funnel part in each of the projection tubes 30, 31 and 32 not only preferably reduce unnecessary light emission on the phosphor layers due to excitation by scattered electrons, but also improve the contrast of the image on the projection tube. This further improves the contrast of the projected picture image of the projection display system using the above described projection tubes. The contrast values measured with respect to the displayed picture image in the projection display system in FIG. 3 were found to be increased by from 10 to 30% higher than those in a conventional projection display system.

Additionally, it will be understood that a transmission type screen may be employed for the screen of the projection display system illustrated in FIG. 3 so that a back-projection type display system is constituted in which projection tubes, projection lenses and the screen are incorporated inside the cabinet.

As mentioned, the cathode ray display tube constituted in accordance with the present invention is able to reduce the contrast deterioration of the displayed image due to scattered electrons and to improve the reliability of the display tube while maintaining high display brightness. In addition, the projection display system constituted in accordance with the present invention, which uses the above cathode ray display tubes, is a significantly effective one in being able to actually provide a display system for displaying images with high contrast.

What is claimed is:

1. A monochromatic cathode ray display tube using an electron beam acceleration voltage which is equal to or greater than 25 kV, said cathode ray display tube being used for a projection display system, comprising:

a neck part accommodating an electron gun;

a funnel part connected to this neck part;

a face panel part connected to this funnel part;

a phosphor layer formed in the inner surface side of this face panel part;

a metal back layer formed with a metal thin film which is provided over the surface of the phosphor layer opposed to the electron gun; and a scattered electrons suppressing material layer provided on at least both the surface of the metal back layer over the phosphor layer and the inner surface of the funnel part formed on the inner surface of a display tube envelope, wherein the scattered electrons suppressing material layer provided on the surface of the metal back layer over the phosphor layer is formed with an element of atoms or a compound composed of atoms with atomic numbers not less than 3 and not more than 10, and the amount per unit area m ($\mu g/cm^2$) of the scattered electrons suppressing material layer is within a range expressed by $0.05\times V_a^2 \leqq m \leqq 0.35\times V_a^2$, where $V_a$ represents the electron beam acceleration voltage (kV).

2. A monochromatic cathode ray display tube according to claim 1, wherein the metal thin film forming the metal back layer is made of aluminum and the scattered electrons suppressing material layer is formed with laminated layers composed of lamina shaped fine graphite particles each of which has a diameter which is at least ten times larger than a thickness and an average particle size in term of spherical volume not more than 2 μm.

3. A monochromatic cathode ray display tube according to claim 1, wherein the projection display system for projecting on a screen a picture image in red, green and blue uses a corresponding cathode ray display tube for each of red, green and blue colors of the picture image in accordance with a corresponding video signal.

4. A monochromatic cathode ray display tube using an electron beam acceleration voltage which is equal to or greater than 25 kV, said cathode ray display tube being used for a projection display system, comprising:

a neck part accommodating an electron gun;

a funnel part connected to this neck part;

a face panel part connected to this funnel part;

a phosphor layer formed in the inner surface side of this face panel part;

a metal back layer formed with a metal thin film which is provided over the surface of the phosphor layer opposed to the electron gun; and a scattered electrons suppressing material layer provided on at least both the surface of the metal back layer over the phosphor layer and the inner surface of the funnel part formed on the inner surface of a display tube envelope, wherein the scattered electrons suppressing material layer provided on the inner surface of the funnel part of the display tube envelope is formed with an element of atoms or a compound composed of atoms with atomic numbers not less than 3 and not more than 10, and the amount per unit area m ($\mu g/cm^2$) of the scattered electrons suppressing material layer is within a range expressed by $m \geqq 0.1\times V_a^2$, where $V_a$ represents the electron beam acceleration voltage (kV).

5. A monochromatic cathode ray display tube according to claim 4, wherein the projection display system for protecting on a screen a picture image in red, green and blue uses a corresponding cathode ray display tube for each of red, green and blue color of the picture image in accordance with a corresponding video signal.

6. A monochromatic cathode ray display tube according to claim 4, wherein the metal thin film forming the metal back layer is made of aluminum and the scattered electrons suppressing material layer is formed with laminated layers composed of lamina shaped fine graphite particles each of which has a diameter which is at least ten times larger than a thickness and an average particle size in terms of spherical volume not more than 2 μm.

* * * * *